US005369859A

United States Patent [19]

Fan

[11] Patent Number: 5,369,859

[45] Date of Patent: Dec. 6, 1994

[54] METHOD OF MAKING CHEMICAL FIBER KNITTED TOWELLING

[76] Inventor: Sheng-Chi Fan, No. 3-2, Alley 34, Lane 226, Sec. 2, Huan Hsi Rd., Chung Li, Taipei, Taiwan, Prov. of China

[21] Appl. No.: 87,863

[22] Filed: Jul. 9, 1993

[51] Int. Cl.[5] ..... D06C 27/00

[52] U.S. Cl. ..... 28/167; 28/159; 28/162; 66/9 R

[58] Field of Search ..... 28/159, 162, 163, 165, 28/167, 170; 66/9 R, 194; 8/149.2, 149.3, 151

[56] References Cited

U.S. PATENT DOCUMENTS

| | | | |
|---|---|---|---|
| 3,254,510 | 6/1966 | Lesley | 28/159 X |
| 3,302,265 | 2/1967 | Davis et al. | 28/162 X |
| 3,719,062 | 3/1973 | Fleissmer | 28/159 X |
| 4,051,287 | 9/1977 | Hayashi et al. | 28/162 X |
| 4,109,038 | 8/1978 | Hayashi et al. | 28/162 X |
| 4,567,075 | 1/1986 | Krawczyk | 28/162 X |
| 4,712,281 | 12/1987 | Scheller | 28/162 |
| 4,884,325 | 12/1989 | Marzotto | 28/162 X |

FOREIGN PATENT DOCUMENTS

| | | | |
|---|---|---|---|
| 3086876 | 7/1978 | Japan | 28/162 |
| 0046664 | 10/1987 | Japan | 28/162 |
| 1321237 | 6/1973 | United Kingdom | 28/159 |

*Primary Examiner*—Clifford D. Crowder
*Assistant Examiner*—John J. Calvert
*Attorney, Agent, or Firm*—Jacobson, Price, Holman & Stern

[57] ABSTRACT

An improved method of making (100% heat-resisting) chemical or synthetic fiber knitted towelling which includes a step of primary shearing to cut the pile yarn of a knitted fabric, obtained after napping of the fabric; a step of brushing the knitted fabric, after the step of primary shearing by means of the application of two reversed card-wire raising fillets, permitting the knitted fabric to be fed at a speed of 3–4 meters per minute; a step of steam damping at about 100° C. and a step of steam heat drying respectively performed in a dryer; the above steps taking place before the fabric is shaped by a step of setting of the knitted fabric in a heat-setting oven. Further shearing of the pile yarn is employed when needed.

11 Claims, 1 Drawing Sheet

METHOD OF MAKING CHEMICAL FIBER KNITTED TOWELLING

BACKGROUND OF THE INVENTION

The present invention relates to a method of making chemical or synthetic fiber knitted towelling, and more particularly to an improved method of making 100% heat-resisting chemical fiber knitted towelling which eliminates the problems of fiber shedding, pile yarn deformation and pilling.

The current method of making chemical fiber knitted towelling is very simple, as shown in FIG. 1, and includes the steps of knitting (1), dyeing (2), napping (3), and setting in a heat-setting oven at a temperature of between about 160° C.–180° C. (4). After the process of napping, the pile yarn of the knitted fabric is not uniform in length, and broken yarns are still attached to the knitted fabric. Therefore, fiber shedding tends to occur. As a result of washing the towelling, the pile yarn may deform, or form pills.

There is a method of making natural fiber knitted towelling which includes the steps of brushing and shearing so that the pile yarn is maintained uniform in length and evenly spread out. However, this method is not suitable for making chemical fiber knitted towelling because the pile yarn forms into curls if treated by the process of brushing and high temperature treatment. Because the physical properties of chemical or synthetic fibers differ to that of natural fibers, they must be treated by different methods.

SUMMARY OF THE INVENTION

The present invention has been accomplished under the aforesaid circumstances. It is therefore an object of the present invention to provide a method of making 100% heat-resisting chemical fiber knitted towelling which eliminates the problems of fiber shedding, pile yarn deformation and pilling. The present invention provides a method of making chemical fiber knitted towelling which includes procedures of repeated shearing, brushing, steam damping, and drying so that the friction resistance of the fibers of the towelling obtained is improved, the pile yarn of the towelling does not twist into rings and will not deform as a result of washing in water.

In a preferred embodiment the present invention provides an improved method of making chemical fiber knitted towelling, the improvement comprising the steps of primary shearing, brushing, secondary shearing, steam damping, and steam heat drying, employed in proper order before the step of setting and after the step of napping. The pile yarn of the knitted fabric thus obtained after the step of napping is cut to about 5 mm long and then treated by the brushing process by the application of two reversed card-wire raising fillets of specification 27/31, driven by high speed rollers of 1600 RPM, permitting the knitted fabric to be fed at a speed of 3–4 meters per minute. Then, the pile yarn is cut to a uniform length within 2–4 mm. Then, the fabric is steam damped by 100° C. steam in a steam dryer for twenty minutes and then heat dried in the steam dryer at a temperature of about 150° C. for twenty minutes. After the step of heat drying, the fabric is treated through the step of setting to set the shape in a heat-setting oven at a temperature of between about 160° C.–180° C. Thus, towelling is obtained. The towelling may be further treated through an additional shearing process when needed.

DETAILED DESCRIPTION OF THE PREFERRED EMBODIMENT

Figure 1:
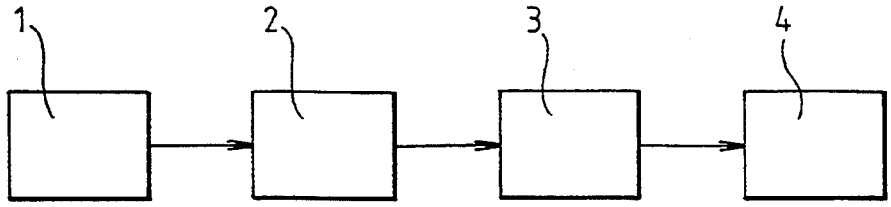
FIG. 1 is a production flow chart of a chemical fiber knitted towelling making method according to the prior art.
Figure 2:
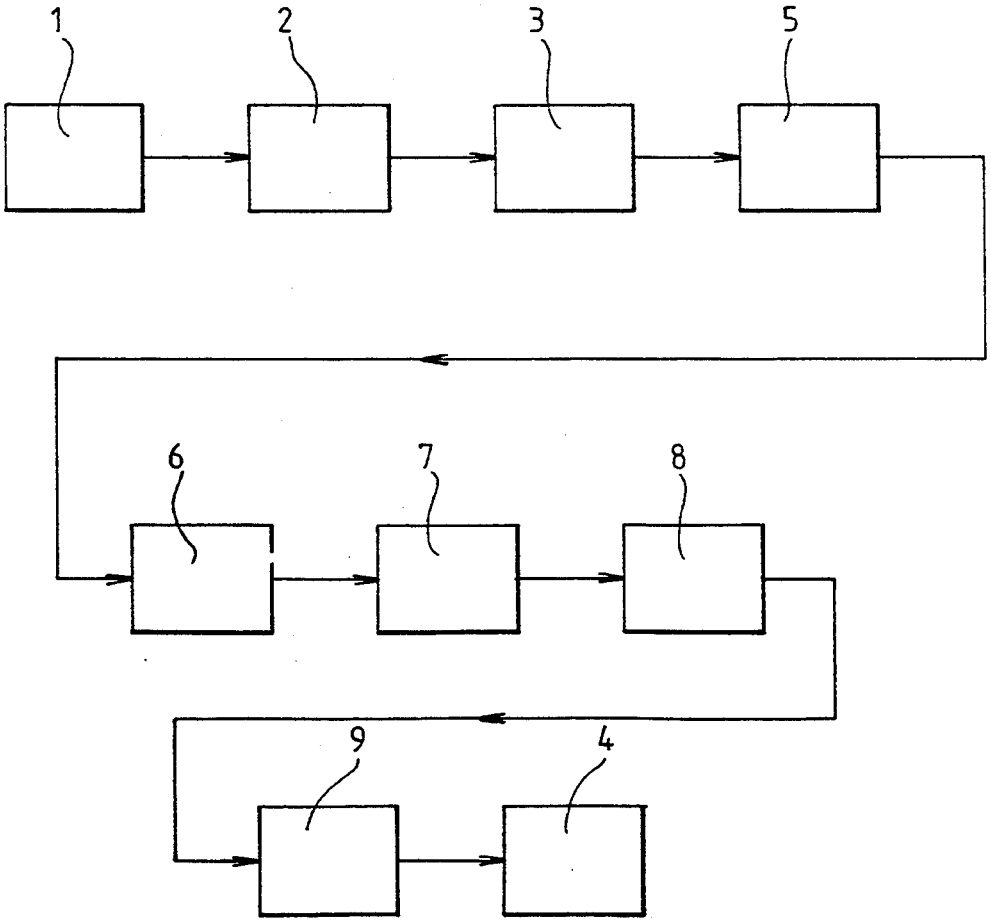
FIG. 2 is a production flow chart of a chemical fiber knitted towelling making method according to the present invention.

Referring to FIG. 2, an improved method of making chemical fiber knitted towelling in accordance with the present invention is illustrated which includes conventional steps of knitting 1, dyeing 2, napping 3, and setting 4. Before setting 4 and after napping 3, the improved method comprises the additional steps of primary shearing 5, brushing 6, secondary shearing 7, 100° C. steam damping for twenty minutes 8, and 150° C. steam heat drying for twenty minutes 9 respectively performed in proper order.

The step of primary shearing 5 is to cut the pile yarn of the knitted fabric to 5 mm long. This process is to remove the unwanted pile yarn from the knitted fabric so that the brushing process can be conveniently performed. The step of secondary shearing 7 is to cut the pile yarn to 2–4 mm long. Before the step of secondary shearing 7, the pile yarn is treated by the process of brushing 6. After the step of secondary shearing 7, the pile yarn of the knitted fabric becomes uniform in length and is evenly distributed. The step of brushing 6 is performed by means of the application of two reversed card-wire raising fillets of specification of 27/31 from James Holdsworth (British company) driven by high speed rollers of 1600 RPM. The knitted fabric is fed at a speed of about 3–4 meters per minute. After the process of brushing 6, the pile yarn of the knitted fabric is raised straight, and as a result of the loose fires being removed the binding power of the fibers are improved as well as the brilliance of the knitted fabric.

After the primary shearing step 5 and secondary shearing step 7 and the brushing procedure 6 therebetween, broken fibers have been removed from the knitted fabric. Then, the fabric is treated through the process of 100° C. steam damping for 20 minutes by putting the fabric in the drum of an industrial dryer, which is alternatively rotated in either direction at 34 RPM, while the fabric is simultaneously steam damped by 100° C. steam for about 20 minutes through steam damping 8. This process greatly improves the friction resistance and shrinkage resistance of the fabric. After the step of 100° C. steam damping 8, fine, uniform knitted fibers, evenly distributed over the surface of the fabric are formed and the towelling is soft and beautiful. After steam damping 8, the fabric is dried in the industrial dryer at 150° C. for twenty minutes through heat drying 9. When cooled down, the fabric is treated through the process of setting 4 in a heat-setting oven under 160° C. to 180° C. Further shearing may be employed if needed.

What is claimed is:

1. A method of making synthetic fiber knitted towelling requiring the steps of knitting a fabric to produce a knitted fabric, dyeing the knitted fabric, napping the knitted fabric to raise a downy surface on the knitted fabric and heat setting to set the shape and finish the appearance of the knitted fabric the improvement comprising the following steps:

(a) shearing pile yarns of said knitted fabric to a uniform length;

(b) brushing said knitted fabric;

(c) steaming to damper said knitted fabric in a steam dryer; and (d) drying the fabric in the steam dryer;

said steps occurring after the step of napping.

2. The method of claim 1 wherein said steps occur before said knitted fabric has been heat set.

3. The method of claim 1 wherein said shearing cuts the pile yarn to about 5 mm.

4. The method of claim 3 further comprising a secondary shearing step of cutting the pile yarn of said fabric to a length of between 2–4 mm.

5. The method of claim 4 wherein the step of brushing precedes the secondary shearing of said knitted fabric.

6. The method of claim 1 wherein said brushing comprises applying two reversed card-wire raising fillets to said fabric, said fillets being driven by high-speed rollers which in turn feed said knitted fabric.

7. The method of claim 6 wherein the high speed rollers are driven at 1600 RPM to feed said fabric at 3–4 meters per minute.

8. The method of claim 1 wherein said steaming comprises subjecting said fabric to steam at a temperature of about 100° C. for about 20 minutes.

9. The method of claim 1 wherein the steam drying step comprises drying said fabric in an industrial dryer at a temperature of about 150° C. for about 20 minutes.

10. The method of claim 1 wherein said heat setting step comprises placing said knitted fabric in heat-setting oven at a temperature of between 160°–180° C.

11. The method of claim 1 wherein a secondary shearing step occurs after said heat setting step.

* * * * *